US010974879B2

(12) United States Patent
Luburic

(10) Patent No.: US 10,974,879 B2
(45) Date of Patent: Apr. 13, 2021

(54) TAMPER EVIDENT TUB

(71) Applicant: BWAY Corporation, Atlanta, GA (US)

(72) Inventor: Frano Luburic, Costa Mesa, CA (US)

(73) Assignee: BWAY CORPORATION, Atlanta, GA (US)

( * ) Notice: Subject to any disclaimer, the term of this patent is extended or adjusted under 35 U.S.C. 154(b) by 160 days.

(21) Appl. No.: 16/188,729

(22) Filed: Nov. 13, 2018

(65) Prior Publication Data

US 2019/0077556 A1 Mar. 14, 2019

Related U.S. Application Data

(63) Continuation of application No. 15/467,710, filed on Mar. 23, 2017, now Pat. No. 10,155,609.

(51) Int. Cl.

| | |
|---|---|
| ***B65D 50/06*** | (2006.01) |
| ***B65D 1/22*** | (2006.01) |
| ***B65D 25/28*** | (2006.01) |
| ***B65D 43/16*** | (2006.01) |
| ***B65D 43/22*** | (2006.01) |
| ***B65D 55/06*** | (2006.01) |

(52) U.S. Cl.

CPC ..... *B65D 50/06* (2013.01); *B65D 1/22* (2013.01); *B65D 25/2885* (2013.01); *B65D 43/163* (2013.01); *B65D 43/22* (2013.01); *B65D 55/06* (2013.01); *B65D 2401/05* (2020.05); *B65D 2401/10* (2020.05); *B65D 2401/15* (2020.05); *B65D 2525/281* (2013.01)

(58) Field of Classification Search

CPC ..... E05B 65/104; E05B 13/004; B65D 50/06; B65D 1/22; B65D 25/2885; B65D 43/163; B65D 43/22; B65D 55/06; B65D 2101/0015; B65D 2101/0023; B65D 2525/281; B65D 2101/0007

USPC ..... 220/254.3, 254.1, 260, 324, 315, 836; 215/238, 237, 235, 215, 201; 292/359

See application file for complete search history.

(56) References Cited

U.S. PATENT DOCUMENTS 3,240,375 A * 3/1966 Burrows ..... B65D 43/24 217/60 R 3,759,415 A 3/1973 Rawson (Continued)

OTHER PUBLICATIONS

Alibaba, "Guangzhou factory wholesale high quality clothes cleaning laundry detergent", Accessed Feb. 20, 2018 https://www.alibaba.com/product-detail/Guangzhou-factory-wholesale-high-quality-clothes_60594202908.html.

(Continued)

*Primary Examiner* — Kareen K Thomas

(74) *Attorney, Agent, or Firm* — Morris, Manning & Martin, LLP; Daniel E. Sineway, Esq.; Bryan D. Stewart, Esq.

(57) ABSTRACT

An exemplary tamper evident tub is disclosed. In various embodiments, the exemplary tub includes one or more breakable tabs in near proximity to a lid latching assembly. The one or more breakable tabs, in particular embodiments, prevent access to one or more lift tabs and latches, while the tamper evident tub lid is in a closed position. In various embodiments, the one or more lift tabs and latches are operable to allow for the lid to be opened from a closed position. In some embodiments, removing the breakable tabs allows access to the one or more lift tabs and latches, and further indicates that the exemplary tub has been tampered with.

20 Claims, 13 Drawing Sheets

(56) References Cited

U.S. PATENT DOCUMENTS 3,840,152 A * 10/1974 Hodge ..... B65D 21/022 220/783
4,170,315 A 10/1979 Dubach et al.
4,512,493 A * 4/1985 Von Holdt ..... B65D 43/0208 220/782
4,705,172 A 11/1987 Gage
4,746,008 A * 5/1988 Heverly ..... B65D 55/02 206/1.5
5,100,015 A 3/1992 Vanderstuyf
D350,876 S 9/1994 VanValkenburg
5,353,946 A 10/1994 Behrend
D363,669 S 10/1995 Pennoyer, Jr.
5,577,779 A 11/1996 Dangel
D377,902 S 2/1997 Marucci
5,617,968 A * 4/1997 Luburic ..... B65D 43/0256 220/276
5,979,691 A * 11/1999 Von Holdt ..... B65D 43/0256 220/266
D442,438 S 5/2001 Schankowski
D449,782 S 10/2001 Diaz
D457,038 S 5/2002 Umans et al.
6,401,968 B1 * 6/2002 Huang ..... B65D 43/164 220/832
6,405,885 B1 * 6/2002 Elliott ..... B65D 47/0838 215/237
D464,791 S 10/2002 Lemoine
D473,789 S 4/2003 Crawford
D484,797 S 1/2004 Kipperman et al.
6,712,233 B2 * 3/2004 Arshinoff ..... B65D 21/0219 220/276
D489,530 S 5/2004 Lindsay
6,772,902 B1 8/2004 White
D513,122 S 12/2005 Greene
6,976,607 B2 * 12/2005 Benoit-Gonin .... B65D 47/0838 222/153.06
D513,451 S 1/2006 Richardson
D524,119 S 7/2006 Kim
D530,616 S 10/2006 Kipperman
D544,798 S 6/2007 Young
D556,041 S 11/2007 Flanagan-Kent
D560,489 S 1/2008 Satnick et al.
D562,160 S 2/2008 Cohen
D569,720 S 5/2008 Lablaine
7,374,053 B2 * 5/2008 Herald ..... B65D 47/0804 215/237
D573,844 S 7/2008 Hanson et al.
D581,793 S 12/2008 Manderfield, Jr.
7,611,027 B2 * 11/2009 Kim ..... B65D 41/48 215/305
7,731,049 B2 * 6/2010 Dengel ..... B65D 43/0212 220/284
7,735,665 B2 * 6/2010 Robinson ..... B65D 47/0814 215/237
7,784,635 B2 8/2010 Luburic
D641,164 S 7/2011 Cornu
D644,437 S 9/2011 Lintula
8,167,156 B2 * 5/2012 Milante ..... A61J 1/03 215/209
D663,111 S 7/2012 Paslawski
8,292,101 B1 * 10/2012 Bragg ..... B65D 50/046 215/237
D673,453 S 1/2013 Luburic
8,459,486 B2 * 6/2013 Luburic ..... B65D 43/026 220/276
8,596,493 B2 * 12/2013 Vollers ..... B65D 47/0838 215/211
8,733,550 B2 5/2014 Harvey
8,733,566 B2 5/2014 Druitt et al.
8,839,975 B2 9/2014 Luburic
D731,329 S 6/2015 Joseph
D760,073 S 6/2016 Mather et al.
D784,089 S 4/2017 Furneaux
D807,170 S 1/2018 Fisher
10,676,258 B2 * 6/2020 Lee ..... B65D 50/046
2004/0084464 A1 5/2004 Koo
2005/0242105 A1 * 11/2005 Homann ..... B65D 43/169 220/840
2006/0076260 A1 4/2006 Luburic
2007/0007297 A1 1/2007 Li
2007/0187277 A1 8/2007 Furlong
2009/0057313 A1 * 3/2009 Alvares ..... B65D 21/0219 220/254.1
2009/0289066 A1 11/2009 Dipietro
2010/0308066 A1 12/2010 Perry
2011/0024942 A1 2/2011 Luburic
2011/0031246 A1 2/2011 Massey, Jr. et al.
2012/0205375 A1 8/2012 Hudson
2013/0233753 A1 9/2013 Harvey
2014/0144867 A1 5/2014 Giraud et al.
2014/0190969 A1 7/2014 Huang
2016/0101908 A1 4/2016 Minnette et al.
2016/0280423 A1 * 9/2016 Luburic ..... B65D 7/06
2018/0273258 A1 9/2018 Luburic

OTHER PUBLICATIONS

Bed Bath & Beyond, announced Apr. 17, 2011, accessed on Jan. 17, 2018: https://www.bedbathandbeyond.com/1/1/46493-pyrex-8-cup-measuring-cup-lid.htmi#BVRRWidgetiD.
International Search Report and Written Opinion dated Feb. 22, 2018, mailed in International Application No. PCT/US17/66310.
Webstaurantstore, announced Dec. 11, 2013, accessed on Jan. 17, 2018 https://www.webstaurantstore.com/kitchenaid-k5gb-5-qt-glass-mixing-bowl-with-handle-and-lid-for-stand-mixers/519K5GB.html.

* cited by examiner

TAMPER EVIDENT TUB

CROSS REFERENCE TO RELATED APPLICATIONS

This application is a continuation application of, and claims the benefit of and priority to, U.S. patent application Ser. No. 15/467,710, filed on Mar. 23, 2017, and entitled "TAMPER EVIDENT TUB," the disclosure of which is incorporated herein by reference as if set forth herein in its entirety.

TECHNICAL FIELD

This disclosure relates generally to tubs, and more specifically to tamper evident tubs and containers.

BACKGROUND

There are many tubs and containers in use today with many different types of lids. Further, many household items such as laundry detergent pods, dish soap, food products, etc., require a container and lid that is secure enough to prevent a child from opening the same. Further, it is increasingly important for the integrity of items stored inside a container to be protected. For example, it should be evident if a container has been opened or a seal has been broken for the first time. However, many lid/container combinations that prevent children from opening these containers and are tamper evident are also unnecessarily cumbersome for adults to open. Therefore, there exists a long-felt but unresolved need for a tamper evident and child proof container with a lid that is also not overly cumbersome for adults to open and provides an indication of the integrity of the items contained therein.

BRIEF SUMMARY OF THE DISCLOSURE

Briefly described and according to one embodiment, aspects of the present disclosure generally relate to tubs, and more specifically tamper evident tubs and containers. A tamper evident tub, as described herein, allows for particular components of a container lid to engage and latch onto particular components of a latch assembly, in one embodiment. According to various aspects of the present disclosure, the container lid in a closed position may be engaged with the latch assembly, thereby securing the lid in a closed position. In certain embodiments, the lid may be opened by removing one or more breakable tabs. In a particular embodiment, removing the one or more breakable tabs allows for a user or handler of the container to access the particular lid components and latch assembly components maintaining the lid in a closed position. Upon removal of the breakable tabs, the user or handler of the container may push inward, and then upward, on the lid components to allow for the lid components to unlatch with the latch assembly.

In one embodiment, the present container includes a container body defining an interior cavity, the container body including a bottom and a top edge, wherein the top edge is opposite the bottom and defines an opening to the cavity; a lid coupled to the container body and disposable in an opened or closed position, the lid including a lid tab for engaging with the latch when the lid is in the closed position; and a removable tab disposed on an exterior surface of the container body that blocks access to a chamber, wherein: a latch is defined within the chamber, the latch including an inwardly extending portion that extends towards the container body; the lid tab is received within the chamber through a chamber opening when the lid is in the closed position; and upon removal of the removable tab, the chamber and the lid tab received therein are accessible when the lid is in the closed position.

In various embodiments, the lid tab is deformable from a first position to a second position; upon positioning the lid in the closed position, the lid tab is disposed in the first position wherein at least one outwardly-extending ridge of the lid tab engages an inwardly-extending portion of the latch securing the lid in the closed position; and upon deformably displacing the lid tab from the first position inwardly toward the container body to the second position, the at least one outwardly-extending ridge of the lid tab disengages with the inwardly-extending portion of the latch, whereby the lid can be moved from the closed position towards the open position.

In a particular embodiment, the lid tab includes a downwardly-extending portion that extends downwardly beyond the at least one outwardly-extending ridge when the lid is in the closed position, the downwardly-extending portion for receiving a disengagement force to disengage the lid tab from the first position to the second position. In some embodiments, the lid further includes at least one lid support tab. According to various aspects of the present disclosure, at least a portion of the at least one lid support tab extends beyond the top edge of the container body and into the cavity when the lid is in the closed position. In a particular embodiment, the at least one lid support tab further includes a substantially flat surface for engaging the top edge of the container when the lid is in the closed position. Additionally, according to various aspects of the present disclosure, the container further includes at least one additional latch defined within the chamber, the at least one additional latch including an inwardly-extending portion that extends towards the container body; and at least one additional lid tab with at least one outwardly-extending ridge for engaging with the inwardly-extending portion of the at least one additional latch when the lid is in the closed position.

In one embodiment, the present disclosure discusses a container assembly, the container assembly including a container body defining an interior cavity, the container body including a bottom and a top edge, wherein the top edge is opposite the bottom and defines an opening to the cavity; a latch assembly extending from a face of the container body, wherein the latch assembly defines a chamber including a latch and an opening into the chamber; and a lid including a tab, wherein the tab extends through the opening in the latch assembly such that at least a portion of the tab is disposed within the chamber and engaged with the latch; and a tear strip removably coupled to the face of the container body at least partially occluding access to the chamber.

In various embodiments, the container assembly further includes a hinge integrally formed with the container body and the lid. In some embodiments, the hinge is integrally formed on a side of the container body opposite the latch assembly. Additionally, the container assembly may further include a satellite ring circumscribing the container body and including a top surface substantially perpendicular to the face of the container body. In some embodiments, the satellite ring is integrally formed with the latch assembly. In one embodiment, the top surface of the satellite ring is co-planer and integrally formed with a top surface of the latch assembly. In a particular embodiment, the satellite ring is integrally formed with a hinge integrally formed with the container body and the lid.

According to various aspects of the present disclosure, the tab includes a ridge, and wherein the ridge is a major ridge and the tab further includes at least one minor ridge. In one embodiment, the latch includes a substantially flat surface substantially parallel to a top surface of the latch assembly, the substantially flat surface engaged with a substantially flat surface of the tab. In a particular embodiment, the tab is disposed in a first position and engaged with the latch; the tab is deformable to disengage the latch; and upon disengaging the latch, the tab is moveable in an upward direction, thereby opening the lid.

In certain embodiments, the lid of the container assembly further includes one or more support structures, wherein at least one portion of each support structure extends below the top edge of the container body into the cavity for preventing the lid from being forced open.

These and other aspects, features, and benefits of the claimed tamper evident tub will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

Further features and benefits of the present disclosure will be apparent from a detailed description of various embodiments thereof taken in conjunction with the following drawings, wherein similar elements are referred to with similar reference numbers, and wherein.

DETAILED DESCRIPTION

The above and further features of the disclosed exemplary tub will be recognized from the following detailed descriptions and drawings of particular embodiments. In various embodiments, a tamper evident tub with a lid is disclosed. In particular embodiments, the tub includes a latching mechanism operative to secure the lid in a closed position. In further embodiments, the tub includes one or more breakable tabs located in front of the latching mechanism such that the latching mechanism is accessible by breaking the breakable tabs. According to at least one embodiment, the container is substantially rectangular in shape. In one or more embodiments, the container may be shaped to include one or more handles integrated into the tub body.

The tub discussed herein may be formed in any suitable way. In various embodiments, the tub is formed by injection molding. In particular embodiments, the tub is 3D printed or created via other additive manufacturing means. In further embodiments, various components of the tub are formed or created separately and the various components of the tub are joined or otherwise suitably connected to form the tub. In one embodiment, the tub may be a one piece and unitary tub.

As will be understood by one of ordinary skill in the art, the tub discussed herein may be used for storing or transporting any variety of materials, including, but not limited to: food, paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The tub may be formed from any suitable material or materials for storing or transporting such materials. In various embodiments, the tub is manufactured from plastic (e.g., polyethylene, high-density polyethylene, etc.). In particular embodiments, the tub is manufactured from a metal or composite material.

Figure 1:
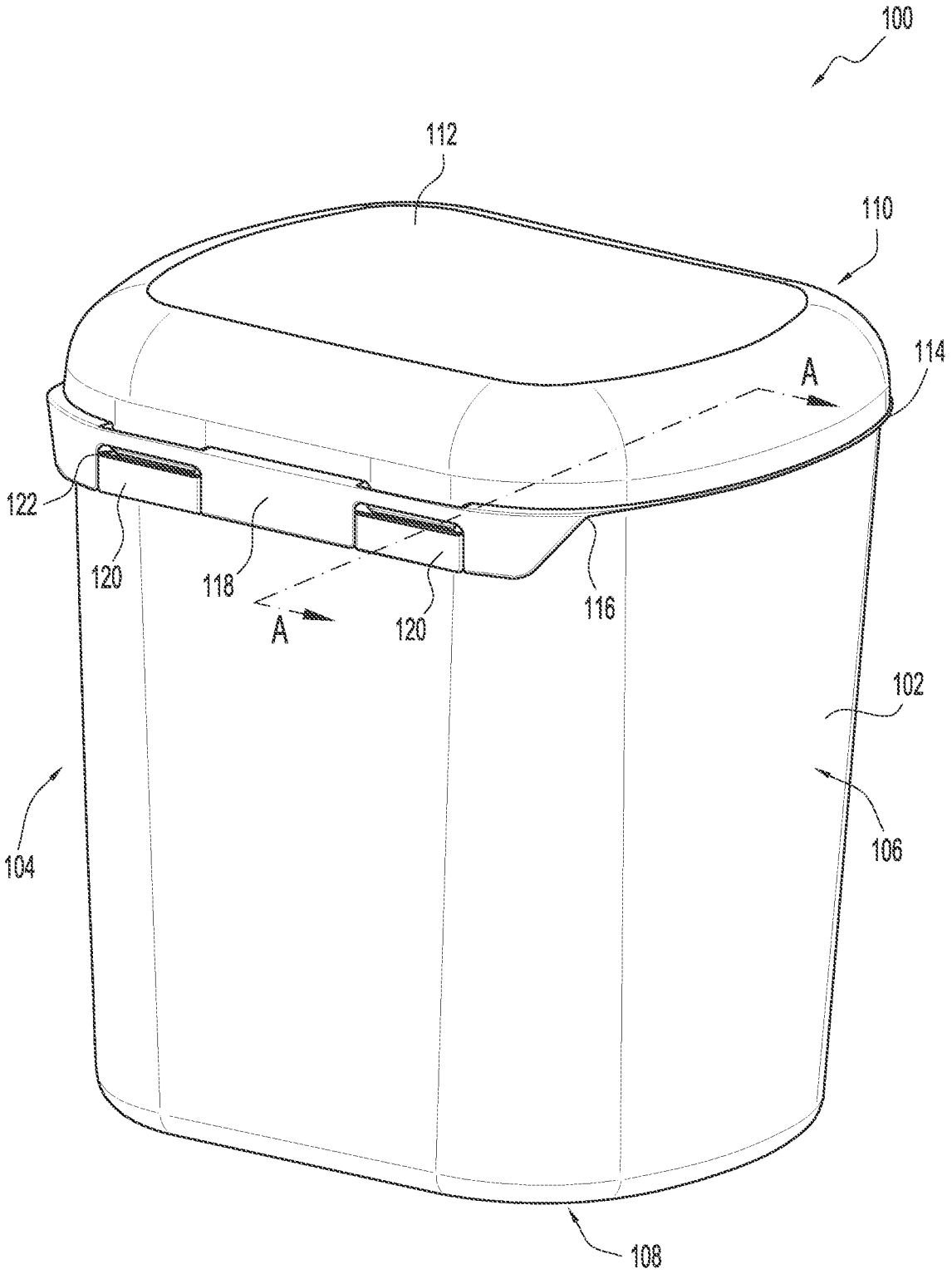
FIG. 1 is an isometric view of an exemplary tub, according to one embodiment of the present disclosure.

Turning now to exemplary tubs illustrated in the figures, FIG. 1 depicts an isometric view of an exemplary tub 100 with a lid 112 in a closed position, according to one embodiment of the present disclosure. In the embodiment shown in FIG. 1, the exemplary tub 100 includes a tub body 102 with a first side 104, second 106, bottom 108, top 110, and the lid 112. According to the present embodiment, the exemplary tub 100 has a substantially rectangular shape with rounded edges. In one embodiment, the top of the lid 112 is flat and the edges of the lid may slope downward in a convex manner. As will be discussed and shown later in the description of FIG. 2, the lid 112 encloses and seals the interior of the tub 100.

In various embodiments, the exemplary tub 100 includes various features proximate the top 110 of the exemplary tub 100. In one embodiment, the exemplary tub 100 includes a satellite ring 114. According to various aspects of the present disclosure, the satellite ring 114 is a protruding ridge that extends outward from the tub body 102. According to one embodiment, the satellite ring 114 has a flat upper surface and round lower surface. In some embodiments, the satellite ring 114 has a round upper surface (convex) and an inwardly round bottom surface (concave), whereby one satellite ring 114 may accept a satellite ring of a separate tub in a stacked configuration (e.g., if the lids are in an open position). In particular embodiments, the satellite ring 114 extends fully or partially around the body 102 of the exemplary tub 100. According to various aspects of the present disclosure, the satellite ring 114 may provide a surface or location for the lid 112 to meet and seal when in a closed position. In various embodiments, the satellite ring 114 acts as a base or starting point from which other tub features extend.

In one embodiment, the satellite ring 114 extends downward at location 116 in order to partially form or integrate with the latch assembly 118. In some embodiments, the latch assembly 118 is entirely separate from the satellite ring 114. In certain embodiments, the latch assembly 118 begins to linearly and gradually increase in width at starting at the location 116. In some embodiments, the linear increase in width of the latch assembly 118 forms about a 45 degree downward angle between the satellite ring 114 and the location 116. In various embodiments, the latch assembly 118 extends about 1.5 inches (3.81 cm) downward from the satellite ring 114. According to various aspects of the present disclosure, the latch assembly 118 extends downward in order to provide a surface to include one or more breakable tabs 120. In various embodiments, the one or more breakable tabs 120 are removable portions of the latch assembly 118. The breakable tabs 120 may be connected to the latch assembly 118 by means of perforated seams, fused corners, or other appropriate means of attachment, and may operate similarly to typical tear strips. In various embodiments, and as will be discussed later in description of FIG. 7, the one or more breakable tabs 120 may be removed to reveal additional features of the exemplary tub 100.

Continuing with FIG. 1, a gap 122 may be located between the upper portion of the one or more breakable tabs 120 and the upper portion of the latch assembly 118. In various embodiments, the gap 122 may allow for a user or handler of the exemplary tub 100 to achieve better leverage to pull away the breakable tab 120. As will be described in greater detail in the discussion of FIG. 2, additional exemplary tub 100 features may be visible through the gap 122.

Figure 2:
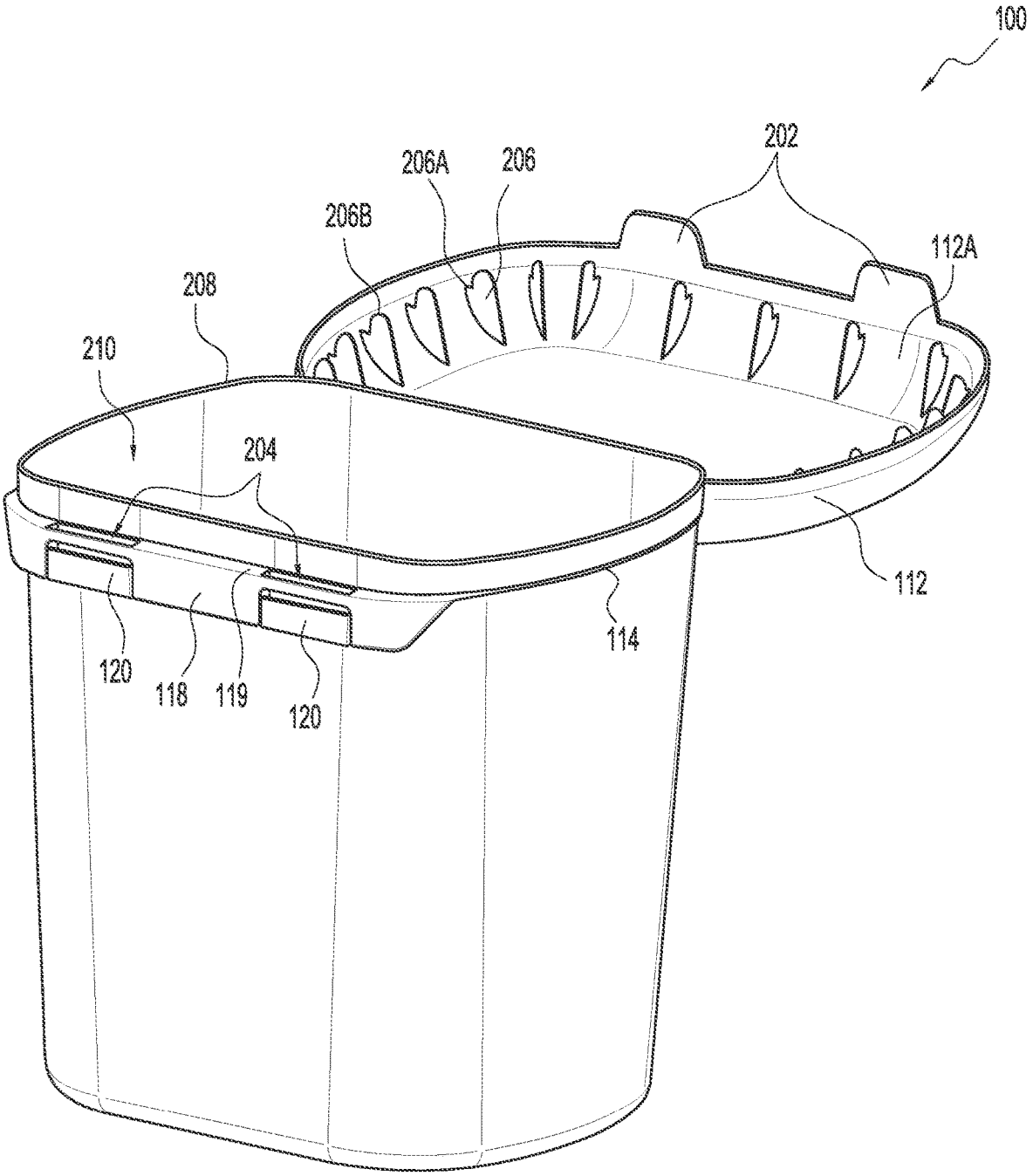
FIG. 2 is a an isometric view of the exemplary tub of FIG. 1 with the lid in an open position prior to being closed, according to one embodiment of the present disclosure.

Proceeding now to FIG. 2, the exemplary tub 100 is shown with the lid 112 in an open position prior to being closed, according to one embodiment of the present disclosure. According to various aspects of the present disclosure, the exemplary tub 100 may be manufactured and distributed with the lid 112 in an open position. In particular embodiments, manufacturing the exemplary tub 100 with the lid 112 in an open position may allow for a user to later fill the exemplary tub 100 with various materials or objects, and then close the lid 112, thereby securing the lid 112 in a closed position. In the present embodiment, the lid 112 is positioned behind the exemplary tub 100 and is facing upward. In various embodiments, the lid 112 includes one or more lift tabs 202. According to various aspects of the present disclosure, while transitioning from an opened position to a closed position, the lift tabs 202 included on the lid 112 may align with and enter the lift tab holes 204.

In particular embodiments, the latch assembly 118 includes an upper surface 119. In various embodiments, the satellite ring 114 may be integrally formed with the latch assembly 118. In certain embodiments, the upper surface 119 is wider than the other portion(s) of the satellite ring 114 in order to include the lift tab holes 204. As will be described in greater detail in the discussion of FIG. 7, the lift tab holes 204 allow for the lift tabs 202 to enter an area behind the breakable tabs 120.

Continuing with FIG. 2, the tub interior 210 is shown, according to one embodiment of the present disclosure. In various embodiments, the tub interior 210 may be operable to store objects and elements ranging from household cleaning supplies, liquids, chemicals, etc. In a particular embodiment, the lid 112 includes a plurality of lid support ribs 206. According to various aspects of the present disclosure, the plurality of lid support ribs 206 are located along the inner curved portion 112A of the lid 112. In certain embodiments, the lid support ribs 206 may be molded onto the curved portion 112A of the lid 112 during the manufacturing process. As mentioned briefly above, the lid 112 may transition from an opened position to a closed position. In one embodiment, while transitioning from an open position to a closed position, the lid support ribs 206 may accept an upper rim 208 of the exemplary tub 100 at the rib location 206A. As shown in the present embodiment, the rib location 206A is a substantially flat portion of the lid support rib 206. In a closed position, each rib location 206A of the plurality of support ribs 206 may accept the tub upper rim 208. According to various aspects of the present disclosure, the plurality of support ribs 206 may include rounded ends 206B. In one embodiment, the rounded ends 206B may extend past the tub upper rim 208 and into the tub interior 210 when in a closed position. In certain embodiments, where the tub interior 210 is filled near the tub upper rim 208, the lid 112 may not close entirely if the elements stored within the tub interior 210 prevent the rounded edges 206B of the plurality of support rubs 206 from extending downward into the tub interior 210.

Figure 3:
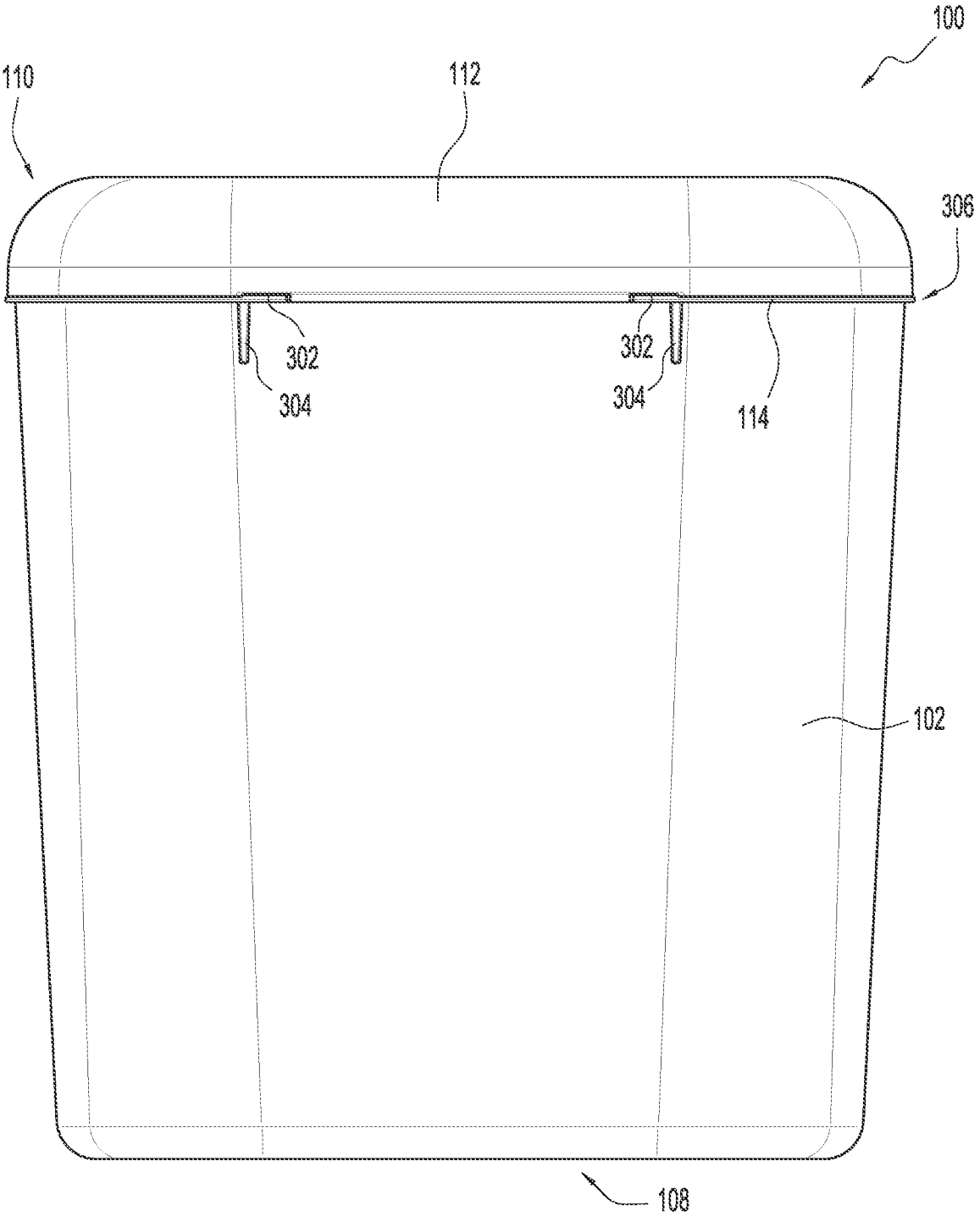
FIG. 3 is a rear view of the exemplary tub of FIG. 1, according to one embodiment of the present disclosure.

Turning now to FIG. 3, a rear view of the exemplary tub 100 is shown according to one embodiment of the present disclosure. In various embodiments, the lid 112 is attached to the tub body 102 by one or more hinges 302. As shown in the present embodiment, two hinges 302 attach the tub lid 112 to the satellite ring 114. In one embodiment, the upper portion of the hinge 302 is integrally attached to the lid 112, and the lower portion of the hinge 302 is integrally attached to the tub body 102. In particular embodiments, the satellite ring 114 may not be included in attaching the lid 112 to the tub body 102 by one or more hinges 302. For example and according to one embodiment, the satellite ring 114 may discontinue circumscribing the tub body 102 in near proximity to the one or more hinges 302. In this example, the one or more hinges 302 may directly attach the lid 112 and the tub body 102 without integrally forming with the satellite ring 114. In one embodiment, a hinge support 304 is included in near proximity to each hinge 302. In the present embodiment, the hinge supports 304 are located below the hinges 302. In various embodiments, the hinge supports 304 are oriented perpendicular to the each hinge 302 and also provide structural support to the hinge 302. In particular embodiments, the hinge supports 304 are integrally formed with the one or more hinges 302 to form one unitary piece. In other embodiments, the hinge supports 304 are integrally formed onto the tub body 102 and one side portion of the hinge supports 304 are integrally formed onto the lower portion of the satellite ring 114.

Continuing with the description of FIG. 3, at location 306, the lid 112 can be seen positioned with a bottom surface in contact, and creating a seal with, the satellite ring 114. In this position, the lid 112 and satellite ring 114 create a flush outer surface at and along the location 306 where it continues around the tub body 102. Additionally, in the present embodiment, both the lid 112 and satellite ring 114 are shown protruding outward from the tub body 102, similar to an umbrella shape. In various embodiments, the container body 102 may taper in dimensions, beginning at the satellite ring 114 and continuing downward towards the tub bottom 108 (e.g., the circumference of the tub 100 at the top 110 is greater than the circumference of the bottom 108). In certain embodiments, the tapered shape of the exemplary tub 100 may allow for the tub 100 to be stacked or placed into another separate tub for storage, transportation, etc.

Figure 4:
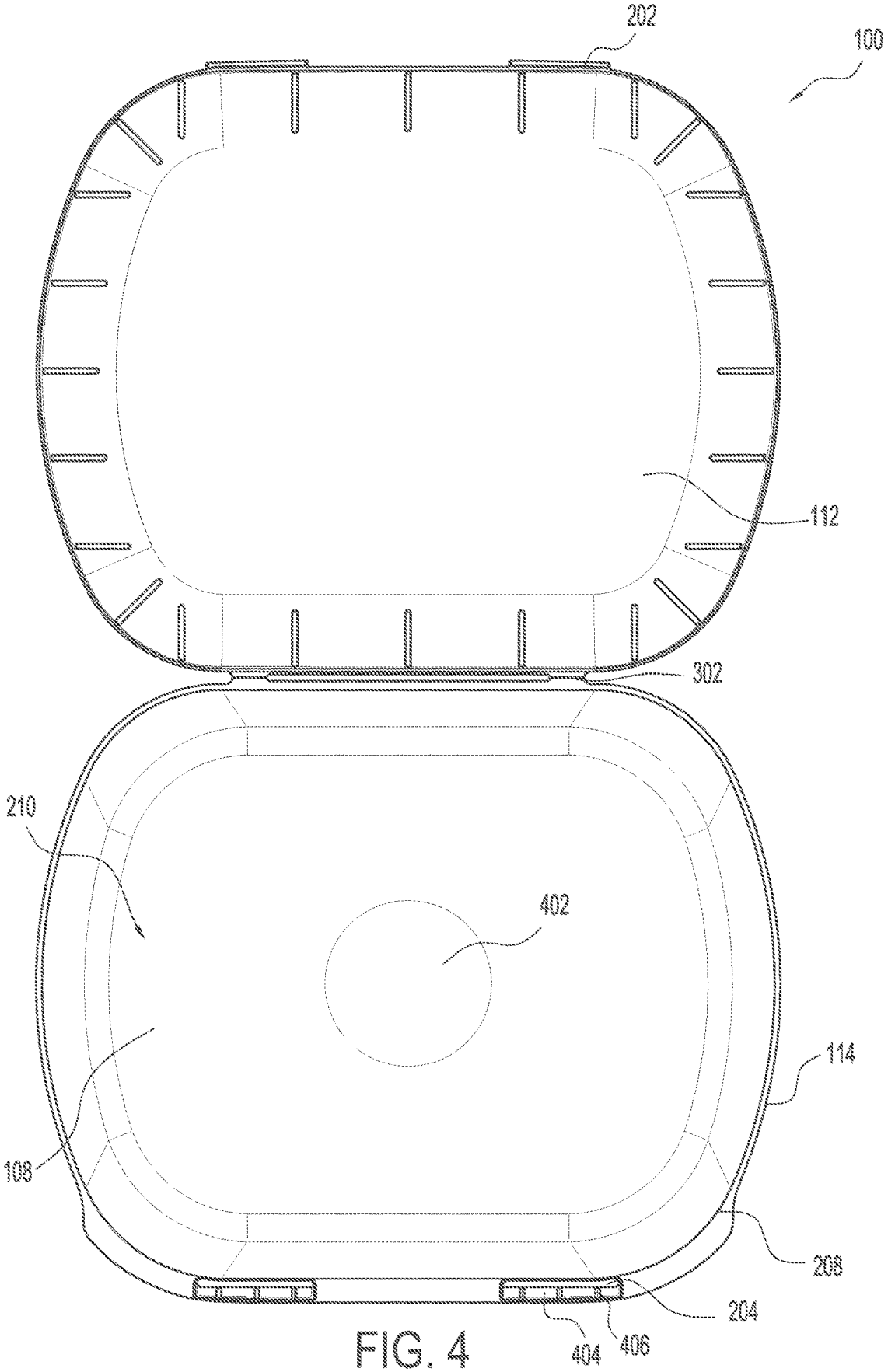
FIG. 4 is a top view of the exemplary tub of FIG. 1, according to one embodiment of the present disclosure.

Turning now to FIG. 4, a top view of the exemplary tub 100 is shown, according to one embodiment of the present disclosure. In the present embodiment, the tub interior 210 is shown. In one embodiment, the tub bottom 108 includes a dimple 402. In various embodiments, the dimple 402 is a spherical indentation that may protrude upward into the tub interior 210, thereby slightly reducing the volume of the tub interior 210.

Continuing with FIG. 4, the lift tab holes 204 are shown from an upper perspective, according to one embodiment of the present disclosure. As can be seen in this view, in the embodiment shown, the exemplary tub 100 includes a latch 404 as well as one or more latch support ribs 406. As will be described in further detail during the discussion of FIG. 6, the latch 404 may include an inwardly extending portion of the latch assembly 118 that secures a lift tab 202, thereby maintaining the lid 112 in a closed position when closed. In particular embodiments, the latch support ribs 406 protect the integrity of the latch 404.

The hinges 302 are shown connecting the lid 112 with the rest of the exemplary tub 100. In the present embodiment, the exemplary tub 100 includes two hinges 302. In various embodiments, the exemplary tub 100 may be manufactured (e.g., molded, 3D printed, etc.) to integrally include the one or more hinges 302. In particular embodiments, the lid 112 and the tub body 102 may be manufactured individually and may be joined or fused at the one or more hinges 302. In other embodiments, the exemplary container 100 includes more or less hinges 302 than shown, depending on certain design configurations and constraints. In one embodiment, the exemplary tub 100 is manufactured as one unitary member.

Figure 5:
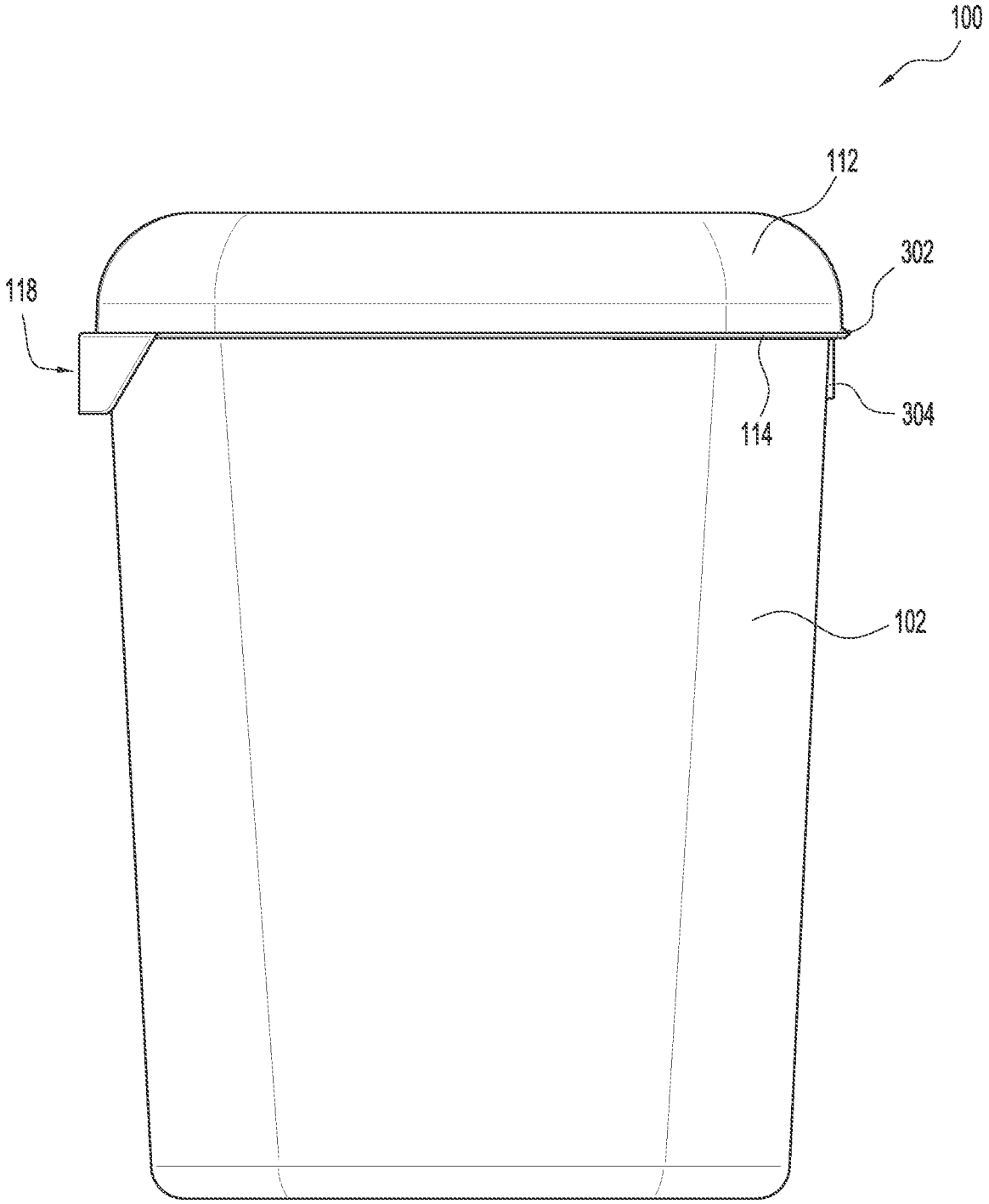
FIG. 5 is a side view of the exemplary tub of FIG. 1, according to one embodiment of the present disclosure.

Turning now to FIG. 5, a side view of the exemplary tub 100 is shown according to one embodiment of the present disclosure. In the present embodiment, the hinge 302 is shown protruding outward slightly beyond where the lid 112 meets the satellite ring 114. Also shown in the present embodiment is the hinge support 304. In one embodiment, the hinge support 304 may be molded to or otherwise attached to both the hinge 302 and the tub body 102. In various embodiments, the hinge support 304 may extend downward along the tub body 102 about 1.0 inches (2.54 cm) from the bottom of the hinge 302. In particular embodiments, the attachment of the hinge support 304 to both the hinge 302 and the tub body 102 provides structural support to the hinge 302 as well as the lid 112.

Figure 6:
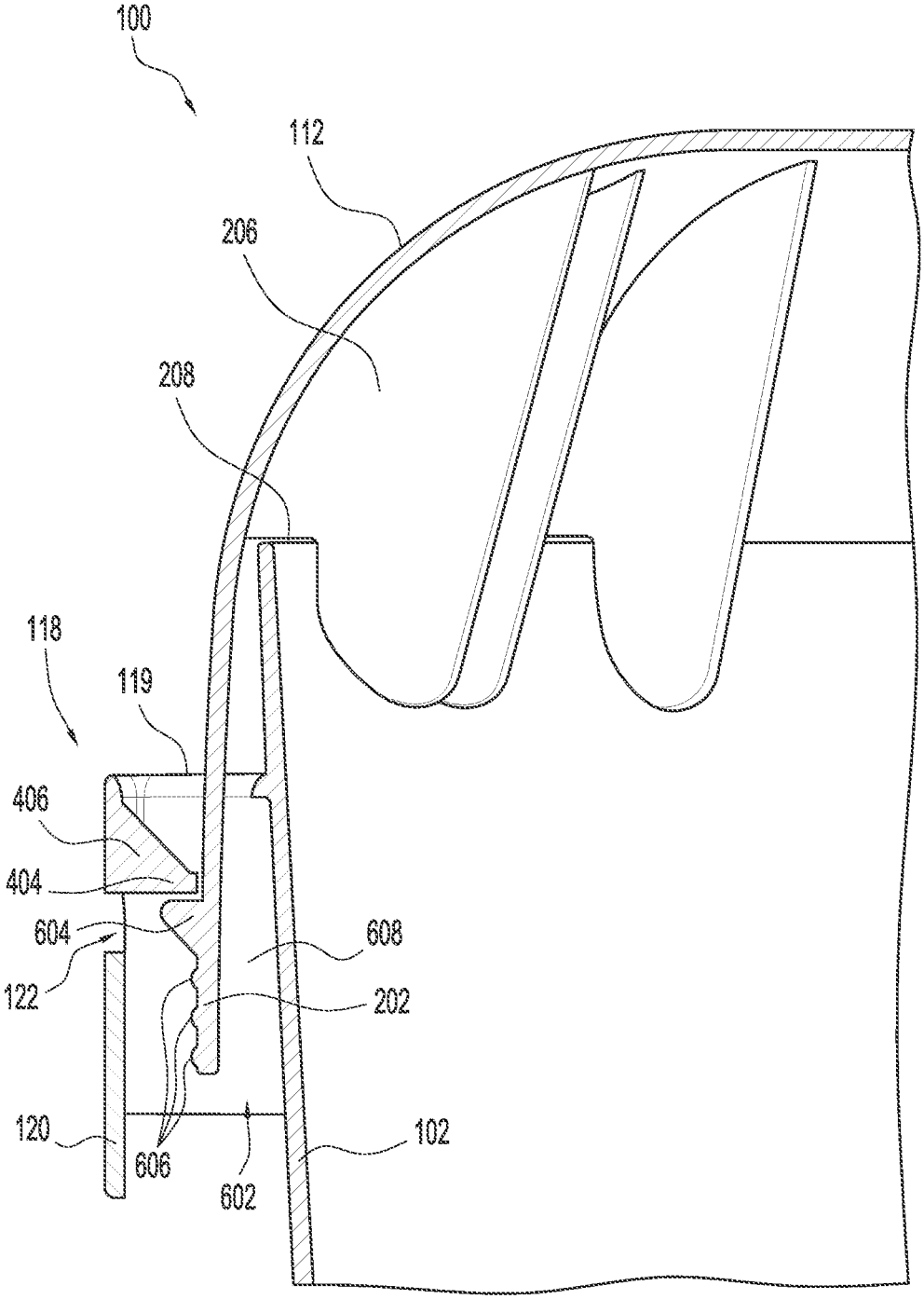
FIG. 6 is a first cross sectional view of the closure mechanism of the exemplary tub of FIG. 1, according to one embodiment of the present disclosure.
Figure 7:
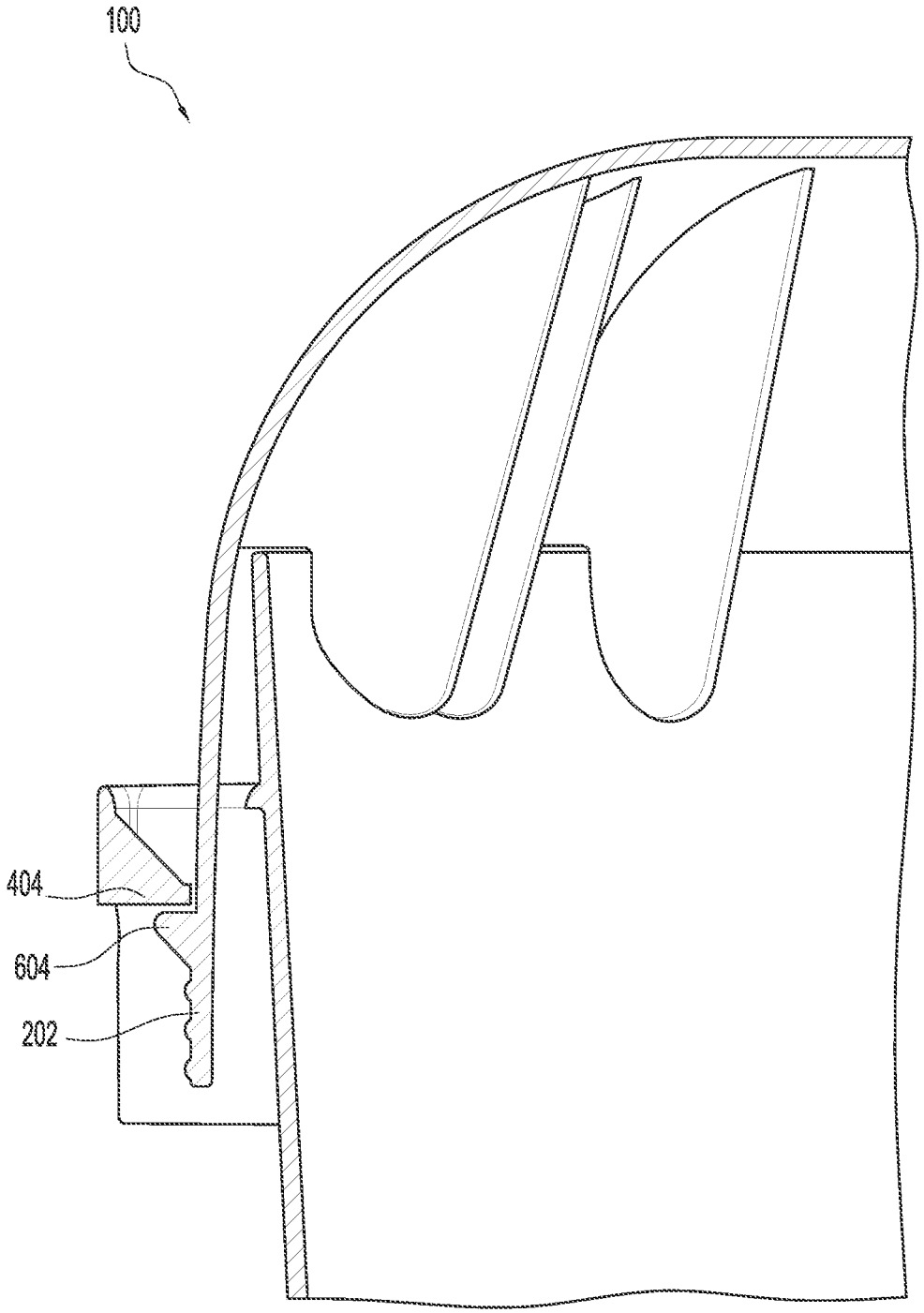
FIG. 7 is a second cross sectional view of the closure mechanism of the exemplary tub of FIG. 1, according to one embodiment of the present disclosure.
Figure 8:
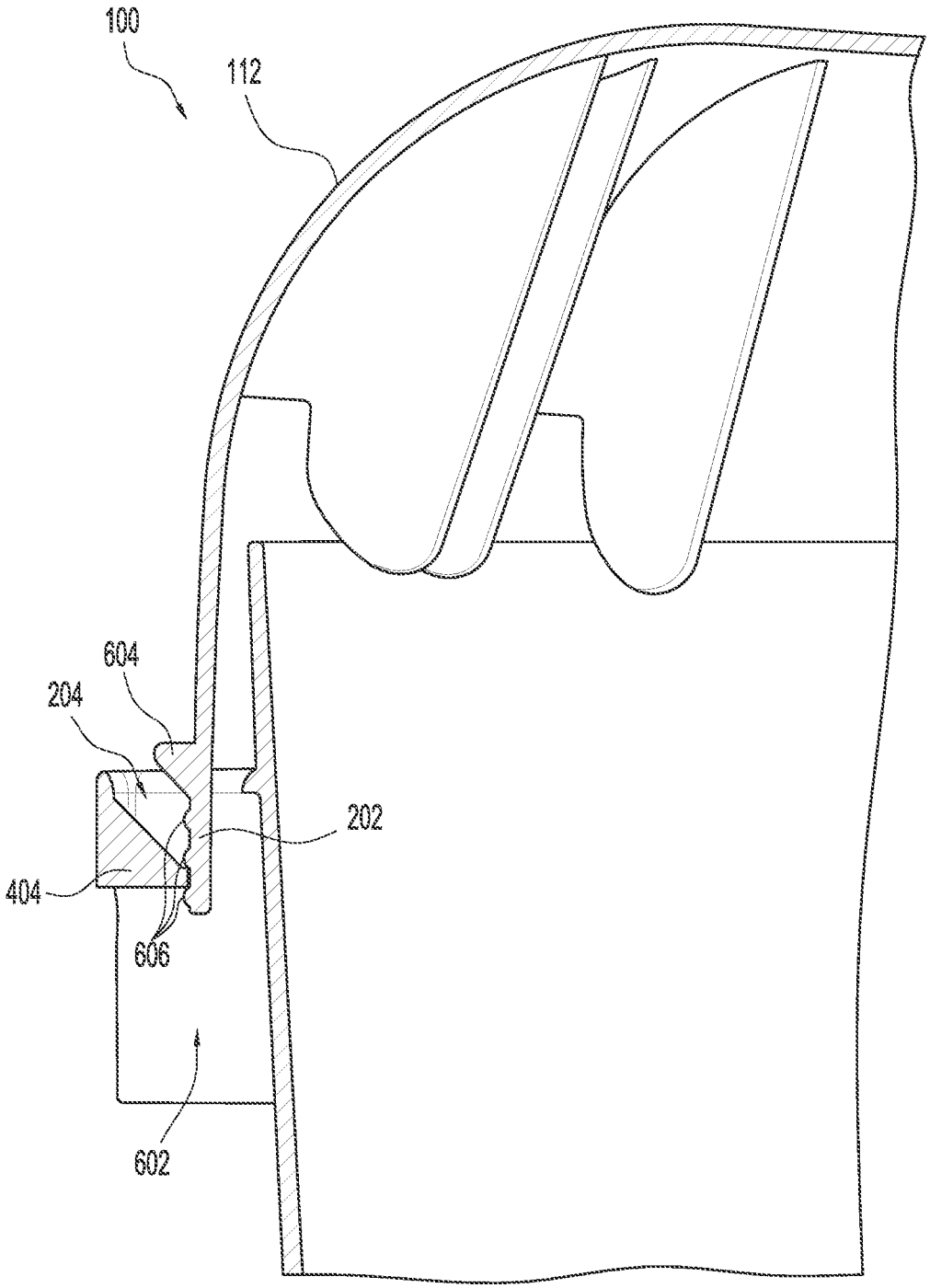
FIG. 8 is a third cross sectional view of the closure mechanism of the exemplary tub of FIG. 1, according to one embodiment of the present disclosure.

As will be described in greater detail below, FIGS. 6, 7, and 8, show cross sectional views taken through the lid 112 and latch assembly 118 (indicated by the dashed line A-A in FIG. 1), according to various aspects of the present disclosure. In various embodiments, the cross sectional views show how the lift tab 202 (and individual portions thereof) engages with the latch assembly 118 (and individual portions thereof) throughout the transition of opening and closing the lid 112.

FIG. 6 shows a cross section taken through the latch assembly 118 and a breakable tab 120 of the exemplary tub 100 with the lid 112 in a closed position. In the present embodiment, the cross section reveals a lift tab chamber 602 with a lift tab 202 occupying the space therein. In this embodiment, the lift tab 202 is shown in a latched position within the lift tab chamber 602. In one embodiment, the lift tab 202 includes a latch tooth 604. According to various aspects of the present disclosure, the latch tooth 604 may have a substantially triangular shape. As seen in the present embodiment, the latch tooth 604 resembles a right-angled triangle. In other embodiments, the latch tooth 604 may be any outwardly extending ridge of the lift tab 202 and may resemble any shape that allows for one directional movement when engaged with another object (e.g., a hook). In a particular embodiment, the object the latch tooth 604 is engaged with is the latch 404. In various embodiments, the angled side of the latch tooth 604 may allow for the latch tooth 604 to pass over the latch 404. In one embodiment, once the acute-angled side of the latch tooth 604 has passed over the latch 604, the right-angled side of the latch tooth 604 may prevent the latch tooth 604, and thus the lift tab 202, from retreating backward. For example, and for the purpose of understanding, the latch tooth 604 and latch 404 may behave similarly to a latch bolt on a door. Generally, the latch bolt on a door is angled and allows for the door to be easily closed; however, once the door is closed it will not reopen by simply pulling the door back outward.

In one embodiment, the lift tab 202 includes a downwardly-extending portion below the latch tooth 604. According to various aspects of the present disclosure, included on the downwardly-extending portion of the lift tab 202 are one or more press ridges 606. In the present embodiment, three press ridges 606 are shown as rounded protrusions protruding from the lift tab 202. As will be discussed in greater detail during the description of FIG. 7, a user may inwardly (towards the tub body), and then upwardly (out of the lift tab chamber), push the lift tab 202 via the press ridges 606 in order to unlatch or release the lift tab 202 from the closed position within the lift tab chamber 602. In one embodiment, the press ridges 606 may allow a user to better grip the region of the lift tab 202 for a user to press. In some embodiments, the lift tab 202 may include more or less press ridges 606 as shown (e.g., two press ridges, one press ridge, many press ridges, no press ridges, etc.).

In one embodiment, a lift tab chamber wall 608 is seen behind the lift tab 202. According to various aspects of the present disclosure, at least two lift tab chamber walls 608 define the space of the lift tab chamber 602. In particular embodiments, the lift tab chamber walls 608 are substantially perpendicularly aligned with the tub body 102, thereby defining a space outward from the tub body 102. In one embodiment, the lift tab chamber walls 608 extend downward from the upper surface 119 of the latch assembly 118 to below the lowest portion of the lift tab 202. In various embodiments, the lift tab chamber walls 608 extend below the lowest portion of the lift tab 202 to prevent access to the lift tab 202 while the breakable tab 120 is still attached to the latch assembly 118. In certain embodiments, the lift tab chamber walls 608 may be integrally formed with the latch assembly 118 and the tub body 102. In other embodiments, only one side of the lift tab chamber walls 608 are integrally formed or connected to an adjacent portion of the exemplary tub 100. In various embodiments, the lift tab chamber walls 608 not only define the space of the lift tab chambers 602, but also provide structural support to the latch assembly 118. In certain embodiments, the lift tab chamber walls 608 may be triangular shaped, rectangular shaped, quadrant shaped, etc.

Continuing with FIG. 6, a cross section of the breakable tab 120 is shown, according to one embodiment of the present disclosure. In one embodiment, the breakable tab 120 is positioned slightly below the latch 404, thus creating the gap 122 seen from the front of the exemplary tub 100 in FIG. 1. The gap 122 between the breakable tab 120 and the latch 404 may allow for a user or handler of the exemplary tub 100 to see the latch tooth 604 but not access the press ridges 606. In some embodiments, the breakable tab 120 may be flush with the latch 404, (or any portion of the latch assembly 118) thereby eliminating the presence of the gap 122. In particular embodiments, the breakable tab 120 may prevent children, or any user with under-developed dexterity skills, from opening the exemplary tub 100 until the breakable tab 120 is removed. In certain embodiments, even when a breakable tab 120 is removed and the lift tab 202 is exposed, a user with under-developed dexterity skills may still struggle to open the lid 112.

In the present embodiment, and located immediately above the cross section of the latch 404 is a cross section of a latch support rib 406. In particular embodiments, the latch support rib 406 has a substantially triangular shape and is attached to or integrally formed with the latch 404 as well as the latch assembly 118. In other embodiments, the latch support rib 406 may have rectangular shape, a quadrant shape, etc. As described previously in the discussion of FIG. 4, the latch support rib 406 provides structural support to the latch 404. For example, a scenario may arise where an upward force is being exerted on the lid 112 in an attempt to open the exemplary tub 100. In this scenario, the latch support rib 406 may distribute the force between the latch 404 and the latch assembly 118. In various embodiments, distributing the force between the latch 404 and the latch assembly 118 may prevent the latch 404 from either becoming deformed or breaking under the force, thereby keeping the lid 112 in a closed position.

In certain embodiments, the lid 112 includes a natural bend and flex. As seen in the present embodiment, the lift tab 120 in its natural state extends away from the exemplary tub 100. In particular embodiments, the natural bend and flex of the lid 112 allows for the lift tab 202 to remain in a latched position. According to various aspects of the present disclosure, the initial form of the lid 112, as developed during manufacturing, may be the source of the outward force allowing the lift tab 202 to remain in a latched position. Moreover, the natural bend and flex of the lid 112 allows for the lift tab 202 to extend back outward after being pressed inward by a user or handler of the exemplary tub 100, according to one embodiment of the present disclosure.

In one embodiment, the support ribs 206 are shown accepting the upper rim 208 of the exemplary tub 100. According to various aspects of the present disclosure, the support ribs 206 may provide support to the exemplary tub 100 and prevent the exemplary tub 100 from being compressed or deformed under extreme conditions. For example, consider a scenario where the exemplary tub 100 is exposed to forces pushing inward on the sides of the exemplary tub 100. In this scenario, the support ribs 206 may prevent the upper rim 208 from bending inward, and thus preventing the exemplary tub 100 from becoming deformed and thus preventing unintended access to the contents of the exemplary tub 100.

Turning now to FIG. 7, an embodiment similar to FIG. 6 is shown with the breakable tab 120 removed. In one embodiment, removing the breakable tab 120 allows for a user to access the lift tab 202. In various embodiments, the breakable tab 120 may be connected to the latch assembly 118 by means of perforated seams, fused corners, or other appropriate means of attachment. In particular embodiments, removing the breakable tab 120 may require a user or handler to exert a force, thereby ripping or tearing away the breakable tab 120. In other embodiments, the user may pop the breakable tab 120 inward or outward to dislocate the breakable tab 120 from its initial position. In various embodiments, once the breakable tab 120 has been removed, a user or handler of the exemplary tub 100 may push the lift tab 202 inward and then upward to open the lid. According to various aspects of the present disclosure, pushing the lift tab 202 inward positions the right-angled side of the latch tooth 604 away from the latch 404. Further, pushing the lift tab 202 upward after it has been pushed inward allows for the latch tooth 604 to avoid being prohibited by the latch 404. In one embodiment, the result of this action may be seen at FIG. 8.

Turning now to FIG. 8, the latch tooth 604 is shown in an intermediate removal position and is mostly removed from the lift tab chamber 602 and partially removed from the lift tab hole 204. In the present embodiment, the edge of the latch 404 is in contact with the space between two of the press ridges 606. In this embodiment, the press ridges 606 on the lift tab 202 may further prevent the lid 112 from opening or closing. In particular embodiments, pushing inward on the lift tab 202, and then either upward or downward, may allow for the lift tab 202 to further exit the lift tab chamber 602 or reenter the lift tab chamber 602.

Figure 9:
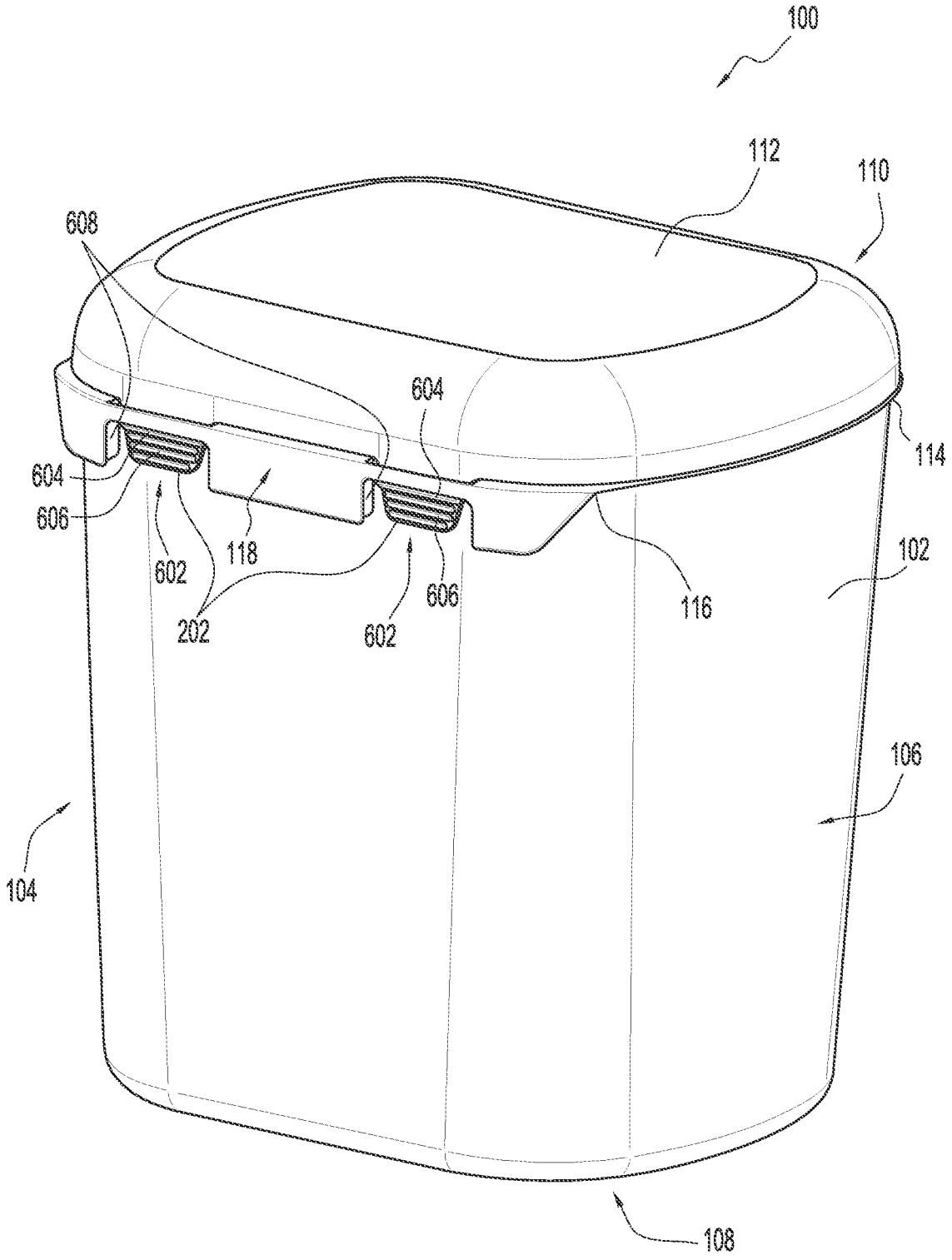
FIG. 9 is an isometric view of the exemplary tub of FIG. 1 with the lift tabs removed, according to one embodiment of the present disclosure.

Turning now to FIG. 9, the exemplary tub 100 is shown without the breakable tabs 120, according to one embodiment. In the present embodiment, the breakable tabs 120 may have been removed from the latch assembly 118. As seen previously in FIG. 2, the exemplary tub 100 may be manufactured and distributed with the lid 112 in an opened position and the breakable tabs 120 included on the latch assembly 118. In one embodiment, closing the lid 112 may result in the lift tabs 202 being secured in the latch assembly 118 behind the breakable tabs 120, as seen in FIG. 1. In particular embodiments, removing the one or more breakable tabs 120 allows access to the lift tab chamber 602. As seen in the present embodiment, positioned within the lift tab chambers 602 are the lift tabs 202. According to various aspects of the present disclosure, the latch tooth 604 of the lift tab 202 may be secured below the latch 404 when the lid 112 is in a closed position. In particular embodiments, the latch 404 is concealed behind the front face of the latch assembly 118. In one embodiment, the one or more press ridges 606 protrude outward from the lift tab 202. In certain embodiments, pushing inward and then upward on each lift tab 202 via the press ridges 606 allows for the latch tooth 604 to disengage the latch 404, thereby allowing the lid 112 to be lifted into the open position. In one embodiment, pushing inward and then upward on each lift tab 202 may be difficult for users that have under-developed dexterity skills (i.e., children), thereby preventing certain users from opening the lid 112.

Figure 10:
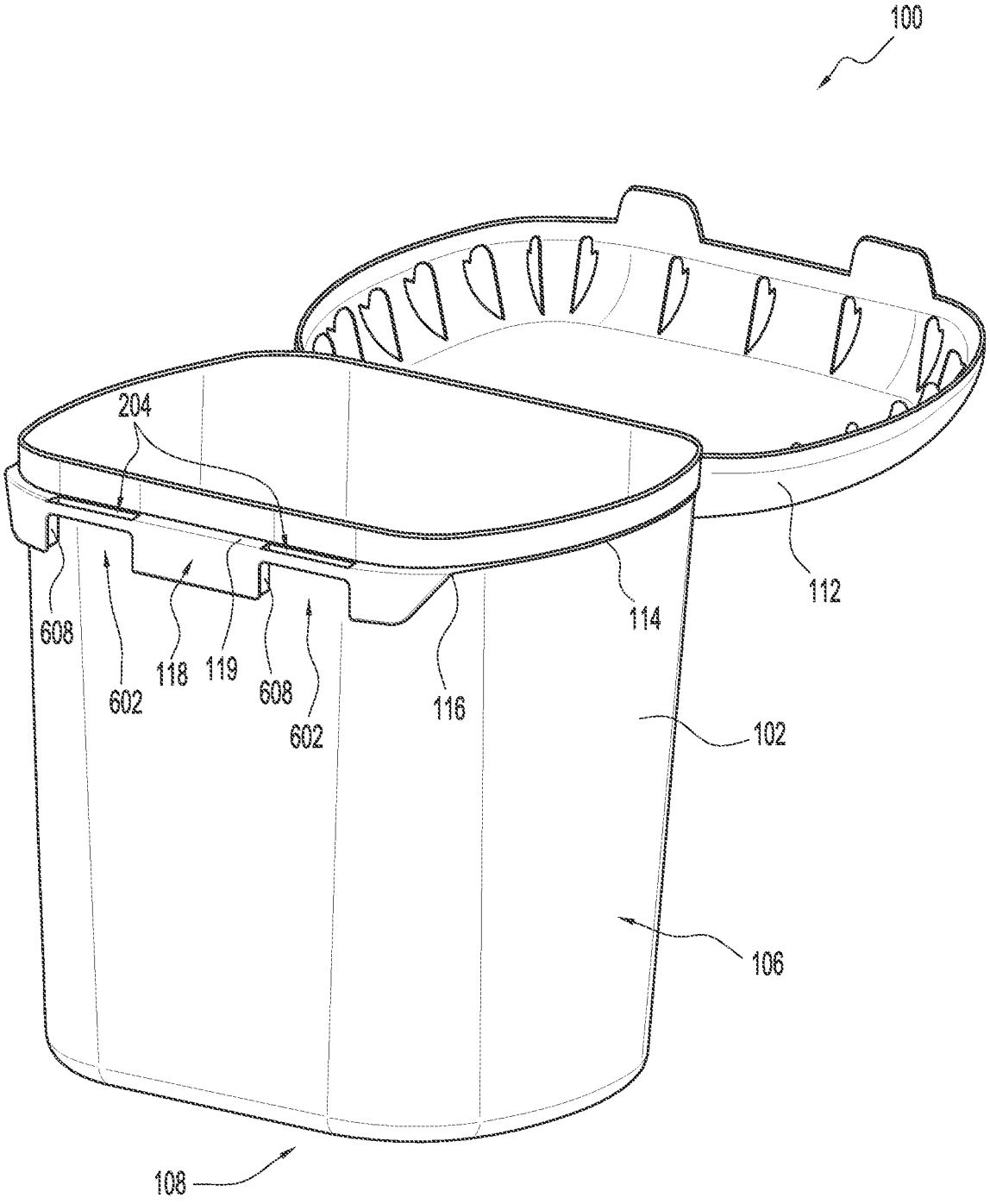
FIG. 10 is an isometric view of the exemplary tub of FIG. 2 with the lift tabs removed, according to one embodiment of the present disclosure.

FIG. 10 shows the exemplary tub 100 with the lid 112 in an open position and without the breakable tabs 120. As described above in the discussion of FIG. 9, pushing inward and then upward on each lift tab 202 via the press ridges 606 allows for the latch tooth 604 to disengage the latch 404, thereby allowing the lid 112 to be lifted into an open position. The present embodiment shows the result of the above described action. In certain embodiments, while being lifted from a closed position to an open position, the one or more lift tabs 202 are lifted upward through the lift tab chamber 602 and further through the lift tab holes 204.

Figure 11:
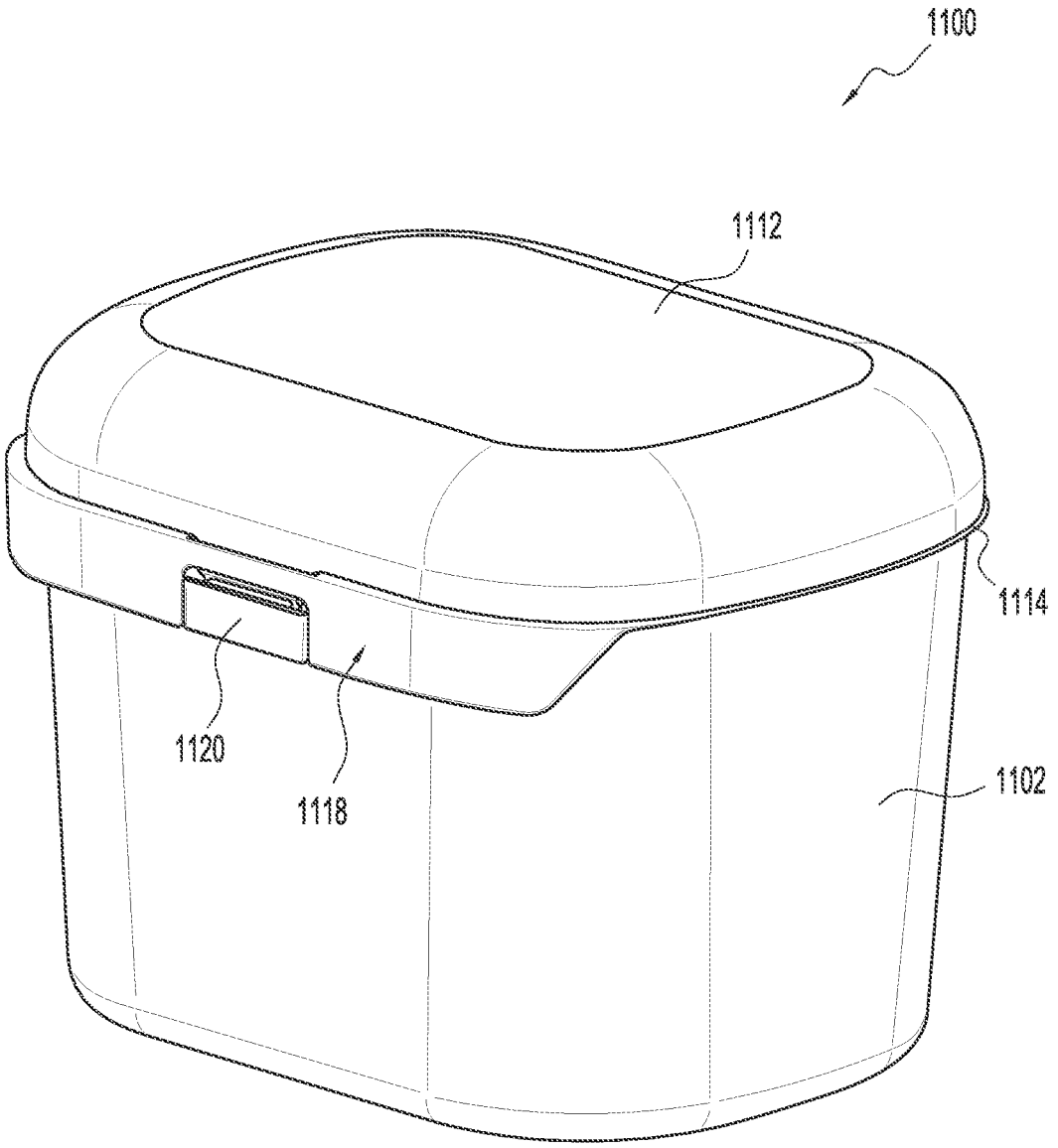
FIG. 11 is an isometric view of a first alternate exemplary tub, according to one embodiment of the present disclosure.

Turning now to FIG. 11, an exemplary tub 1100 is shown according to one embodiment of the present disclosure. In various embodiments, the exemplary tub 1100 is an alternate embodiment of the exemplary tub 100. In the present embodiment, the exemplary tub 1100 includes features substantially similar to the exemplary tub 100 such as the tub body 1102, lid 1112, satellite ring 1114, latch assembly 1118, and breakable tab 1120. In particular embodiments, the lift tab 202, latch tooth 604, and latch 404 included on the exemplary tub 100 are also substantially similar to the same features on the exemplary tub 1100. In certain embodiments, the exemplary tub 1100 may have different dimensions than the exemplary tub 100; however, the functionality of the two tubs is substantially similar. In the present embodiment, the exemplary tub 1100 includes only one breakable tab 1120. In various embodiments, the exemplary tub 1100 (and other alternate embodiments) may include a plurality of breakable tabs 1120.

Figure 12:
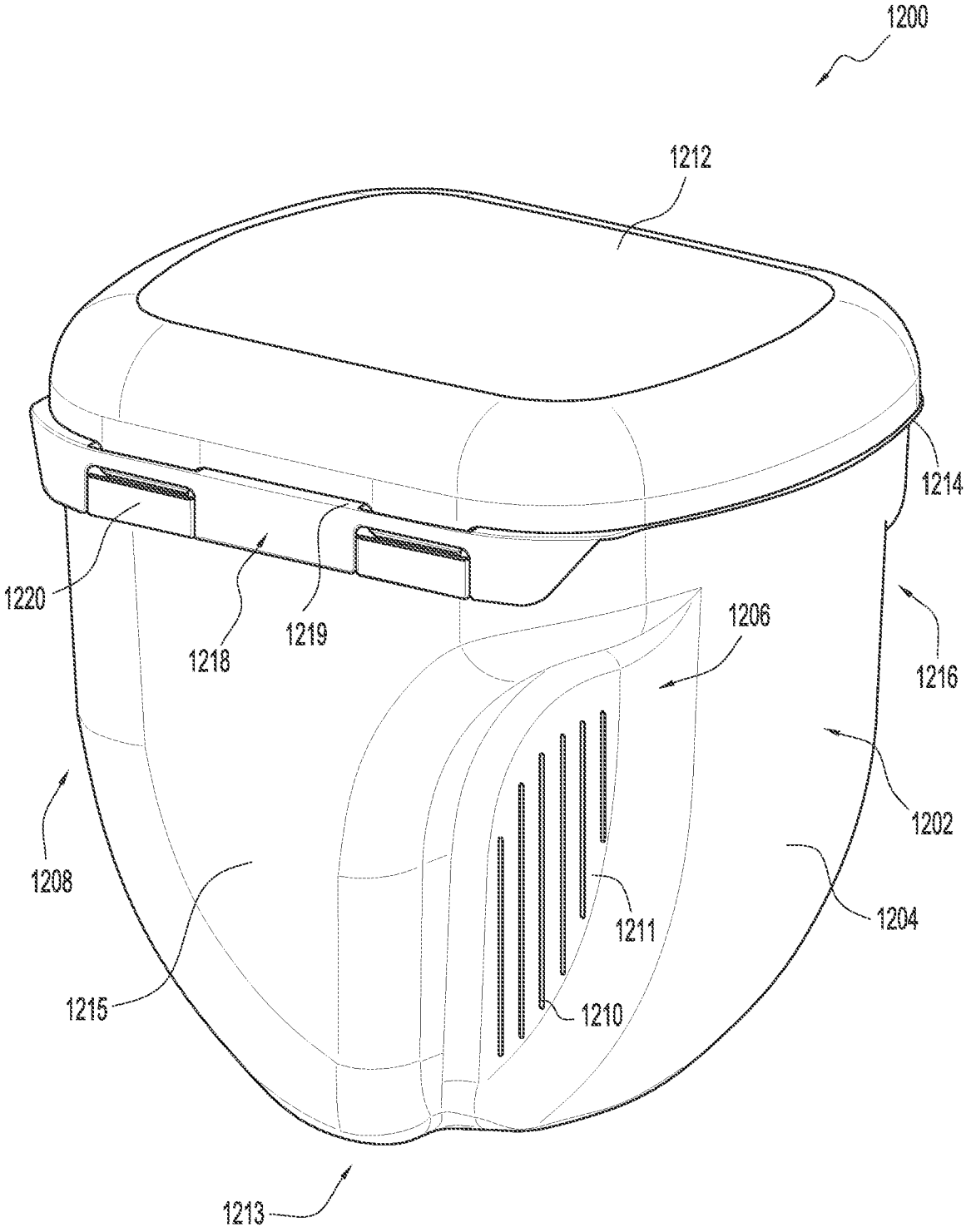
FIG. 12 is an isometric view of a second alternate exemplary tub, according to one embodiment of the present disclosure.

FIG. 12 shows an isometric view of an exemplary tub 1200, according to one embodiment of the present disclosure. In various embodiments, the exemplary tub 1200 is an alternate embodiment of the exemplary tub 100. In the present embodiment, the exemplary tub 1200 includes features substantially similar to the exemplary tub 100 such as the lid 1212, satellite ring 1214, latch assembly 1218, and breakable tab 1220. In particular embodiments, the lift tab 202, latch tooth 604, and latch 404 included on the exemplary tub 100 are also substantially similar to the same features on the exemplary tub 1200. As shown in the present embodiment, the first side 1202 of the exemplary tub 1200 includes a handle 1204. According to various aspects of the present disclosure, the handle 1204 is integrated or molded into the shape of the first side 1202 of the exemplary tub 1200. In various embodiments, the handle 1204 is formed by a recess 1206 in the first side 1202, the front 1215, and the rear 1216 of the exemplary tub 1200. In certain embodiments, the recess 1206 allows for a user or handler of the exemplary tub 1200 to easily grab the tub 1200 with a single hand. In some embodiments, a handle 1204 may be present on both the first side 1202 and the second side 1208 of the exemplary tub 1200. According to various aspects of the present disclosure, the general curvature of the first side 1202 and second side 1208 of the exemplary tub 1200 are substantially similar. As shown in the present embodiment, both the first side 1202 and second side 1208 of the exemplary tub 1200 extend straight downward from the satellite ring 1214 and then proceed to curve inward towards the bottom 1213 of the tub 1200, thereby reducing the volume of the exemplary tub 1200.

Figure 13:
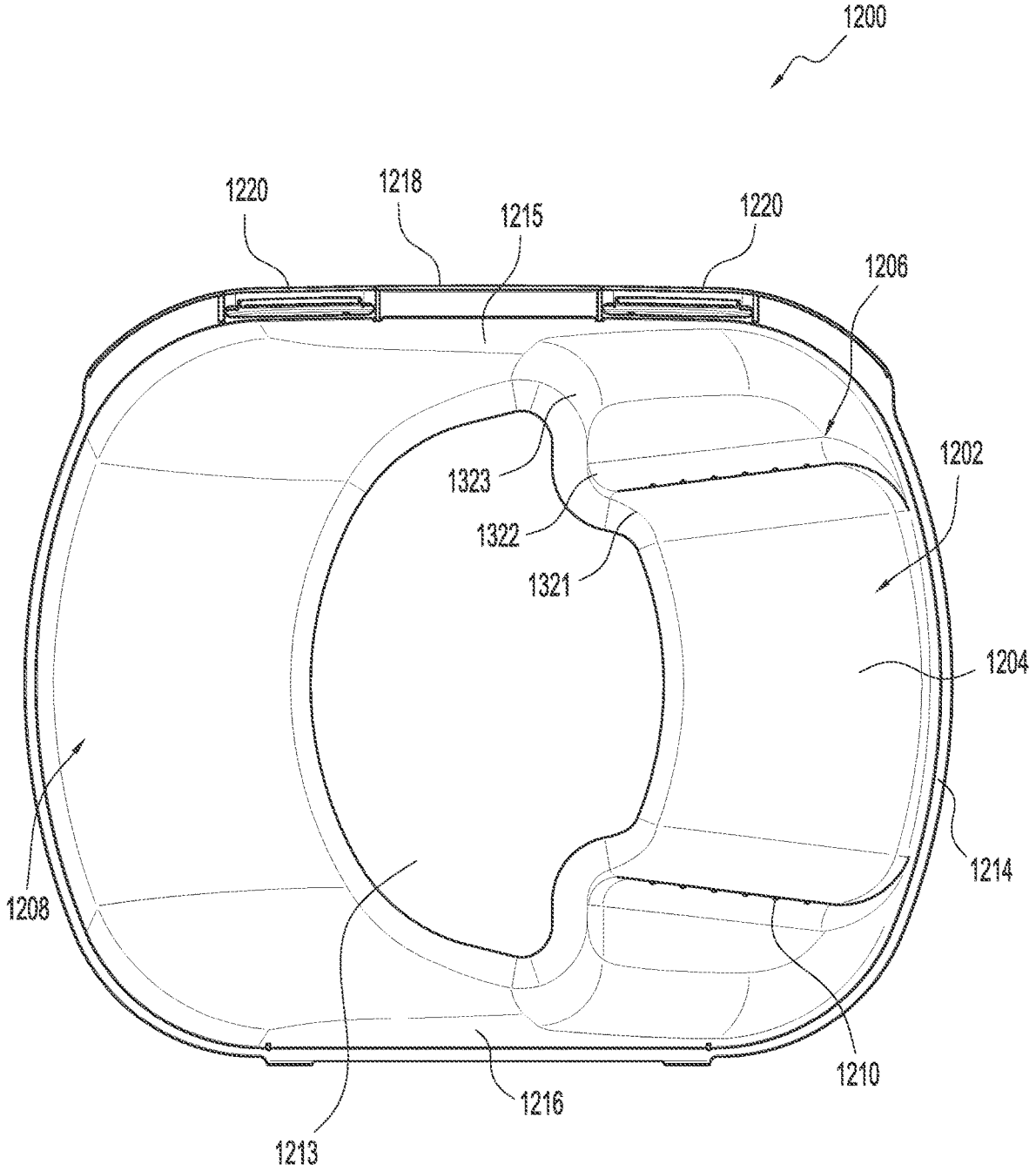
FIG. 13 is a bottom view of the second alternate exemplary tub of FIG. 12, according to one embodiment of the present disclosure.

Continuing with FIG. 12, the handle 1204 includes a plurality of grip ridges 1210. In one embodiment, the plurality of grip ridges 1210 allows for a user or handler of the exemplary tub 1200 to better grasp the tub 1200. In various embodiments, the plurality of grip ridges 1210 protrudes slightly outward from the handle inner surface 1212 (as seen in FIG. 13). In other embodiments, the plurality of grip ridges 1210 may extend inward into the exemplary tub 1200 interior. In a particular embodiment, the grip ridges 1210 are vertically aligned along the handle inner surface 1211. In certain embodiments, the grip ridges 1210 may be horizontally aligned, diagonally aligned, crossed, or another appropriate pattern. In various embodiments, the handle 1204 may not include any grip ridges 1210 at all. In embodiments where the handle 1204 does not include grip ridges 1210, the handle inner surface 1211 may be bare or may include another surface that promotes an enhanced grip such as sandpaper, a tacky substance, etc. In particular embodiments, exemplary tub 1200 may include various types of handles (e.g., jug handles, etc.).

Turning now to FIG. 13, the present embodiment shows a bottom view of the exemplary container 1200. In various embodiments, the bottom 1213 of the exemplary tub 1200 includes a shape that is substantially different from the lid 1212. Referring back to FIG. 4, the bottom 108 of the exemplary tub 100 includes a shape and proportions that are substantially similar to the lid 112. Looking now at FIG. 13, the bottom 1213 of the exemplary tub 1200 includes the curvature of the first side 1202 and second side 1208, and the handle recess 1206. In one embodiment, the bottom 1213 resembles two disproportionate semi-circular halves, wherein the smaller semi-circular half is in near proximity to the handle 1204. In a particular embodiment, each handle recess 1206 reduces the surface area of the tub bottom 1213, thereby creating the smaller semi-circular half. In various embodiments, the handle 1204 tapers inward as the handle 1204 extends downward and bends inward from the satellite ring 1214 to the tub bottom 1213.

Continuing with FIG. 13, the curvature of the handle recess 1206 resembles a valley shape. In the present embodiment, the handle recess 1206 begins to curve inward at location 1321 into the exemplary tub 1200 interior. In one embodiment, the handle recess 1206 then forms a rounded bottom at location 1322. In various embodiments, the rounded bottom at location 1322 represents the inner most portion of the handle recess 1206 and therefore the inner most grab-able portion of the handle 1204. In certain embodiments, the handle recess 1206 then begins to curve outward to location 1323. In particular embodiments, the location 1323 is similar to location 1321 in that both locations are above or outside the inner most portion of the handle recess 1206, which is 1322 in the present embodiment.

CONCLUSION

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof.

What is claimed is:

1. A container, comprising:

a container body defining an interior cavity, the container body comprising a bottom and a top edge, wherein the top edge is opposite the bottom and defines an opening to the cavity;

a lid coupled to the container body and disposable in an opened or closed position, the lid comprising a lid tab for engaging with a latch when the lid is in the closed position and deformable from a first position to a second position; and a removable tab disposed on an exterior surface of the container body that blocks access to a chamber, wherein:

the latch is defined within the chamber, the latch comprising an inwardly extending portion that extends towards the container body;

the lid tab is received within the chamber through a chamber opening when the lid is in the closed position;

upon removal of the removable tab, the chamber and the lid tab received therein are accessible when the lid is in the closed position;

upon positioning the lid in the closed position, the lid tab is disposed in the first position wherein at least one outwardly-extending ridge of the lid tab engages an inwardly-extending portion of the latch securing the lid in the closed position; and upon deformably displacing the lid tab from the first position inwardly toward the container body to the second position, the at least one outwardly-extending ridge of the lid tab disengages with the inwardly-extending portion of the latch, whereby the lid can be moved from the closed position towards the open position.

2. The container of claim 1, wherein the lid tab comprises a downwardly-extending portion that extends downwardly beyond the at least one outwardly-extending ridge when the lid is in the closed position, the downwardly-extending portion for receiving a disengagement force to disengage the lid tab from the first position to the second position.

3. The container of claim 1, wherein the lid further comprises at least one lid support tab.

4. The container of claim 3, wherein at least a portion of the at least one lid support tab extends beyond the top edge of the container body and into the cavity when the lid is in the closed position.

5. The container of claim 4, wherein the at least one lid support tab further comprises a substantially flat surface for engaging the top edge of the container when the lid is in the closed position.

6. The container of claim 1, further comprising:

at least one additional latch defined within the chamber, the at least one additional latch comprising an inwardly-extending portion that extends towards the container body; and at least one additional lid tab with at least one outwardly-extending ridge for engaging with the inwardly-extending portion of the at least one additional latch when the lid is in the closed position.

7. A container assembly, comprising:

a container body defining an interior cavity, the container body comprising a bottom and a top edge, wherein the top edge is opposite the bottom and defines an opening to the cavity;

a latch assembly extending from a face of the container body, wherein the latch assembly defines a chamber comprising a latch and an opening into the chamber;

a lid comprising a tab, wherein the tab extends through the opening in the latch assembly such that at least a portion of the tab is disposed within the chamber and engaged with the latch;

a satellite ring circumscribing the container body and comprising a top surface substantially perpendicular to the face of the container body; and a tear strip removably coupled to the face of the container body at least partially occluding access to the chamber.

8. The container assembly of claim 7, wherein the container assembly further comprises a hinge integrally formed with the container body and the lid.

9. The container assembly of claim 8, wherein the hinge is integrally formed on a side of the container body opposite the latch assembly.

10. The container assembly of claim 7, wherein the satellite ring is integrally formed with the latch assembly.

11. The container assembly of claim 10, wherein the top surface of the satellite ring is co-planer and integrally formed with a top surface of the latch assembly.

12. The container assembly of claim 7, wherein the satellite ring is integrally formed with a hinge integrally formed with the container body and the lid.

13. The container assembly of claim 7, wherein the tab comprises a ridge, and wherein the ridge is a major ridge and the tab further comprises at least one minor ridge.

14. The container assembly of claim 7, wherein the latch comprises a substantially flat surface substantially parallel to a top surface of the latch assembly, the substantially flat surface engaged with a substantially flat surface of the tab.

15. The container assembly of claim 7, wherein:

the tab is disposed in a first position and engaged with the latch;

the tab is deformable to disengage the latch; and upon disengaging the latch, the tab is moveable in an upward direction, thereby opening the lid.

16. The container assembly of claim 7, wherein the lid further comprises one or more support structures, wherein at least one portion of each support structure extends below the top edge of the container body into the cavity for preventing the lid from being forced open.

17. A container, comprising:

a container body defining an interior cavity, the container body comprising a bottom and a top edge, wherein the top edge is opposite the bottom and defines an opening to the cavity;

a lid coupled to the container body and disposable in an opened or closed position, the lid comprising:

a lid tab for engaging with a latch when the lid is in the closed position; and at least one lid support tab, the at least one lid support tab comprising a substantially flat surface for engaging the top edge of the container when the lid is in the closed position, wherein at least a portion of the at least one lid support tab extends beyond the top edge of the container body and into the cavity when the lid is in the closed position; and a removable tab disposed on an exterior surface of the container body that blocks access to a chamber, wherein:

the latch is defined within the chamber, the latch comprising an inwardly extending portion that extends towards the container body;

the lid tab is received within the chamber through a chamber opening when the lid is in the closed position; and upon removal of the removable tab, the chamber and the lid tab received therein are accessible when the lid is in the closed position.

18. A container, comprising:

a container body defining an interior cavity, the container body comprising a bottom and a top edge, wherein the top edge is opposite the bottom and defines an opening to the cavity;

a lid coupled to the container body and disposable in an opened or closed position, the lid comprising a lid tab for engaging with a latch when the lid is in the closed position; and a removable tab disposed on an exterior surface of the container body that blocks access to a chamber, wherein:

the latch is defined within the chamber, the latch comprising an inwardly extending portion that extends towards the container body;

the lid tab is received within the chamber through a chamber opening when the lid is in the closed position; and upon removal of the removable tab, the chamber and the lid tab received therein are accessible when the lid is in the closed position;

at least one additional latch defined within the chamber, the at least one additional latch comprising an inwardly-extending portion that extends towards the container body; and at least one additional lid tab with at least one outwardly-extending ridge for engaging with the inwardly-extending portion of the at least one additional latch when the lid is in the closed position.

19. A container assembly, comprising:

a container body defining an interior cavity, the container body comprising a bottom and a top edge, wherein the top edge is opposite the bottom and defines an opening to the cavity;

a latch assembly extending from a face of the container body, wherein the latch assembly defines a chamber comprising a latch and an opening into the chamber;

a lid comprising a tab, wherein:

the tab comprises a major ridge and at least one minor ridge; and the tab extends through the opening in the latch assembly such that at least a portion of the tab is disposed within the chamber and engaged with the latch; and a tear strip removably coupled to the face of the container body at least partially occluding access to the chamber.

20. A container assembly, comprising:

a container body defining an interior cavity, the container body comprising a bottom and a top edge, wherein the top edge is opposite the bottom and defines an opening to the cavity;

a latch assembly extending from a face of the container body, wherein the latch assembly defines a chamber comprising a latch and an opening into the chamber;

a lid comprising a tab, wherein:

the tab extends through the opening in the latch assembly such that at least a portion of the tab is disposed within the chamber and engaged with the latch;

the tab is disposed in a first position and engaged with the latch;

the tab is deformable to disengage the latch; and upon disengaging the latch, the tab is moveable in an upward direction, thereby opening the lid; and a tear strip removably coupled to the face of the container body at least partially occluding access to the chamber.

* * * * *